US005863037A

United States Patent [19]

Jost

[11] Patent Number: 5,863,037

[45] Date of Patent: Jan. 26, 1999

[54] SHEET GUIDE DEVICE FOR SHEET FEEDERS

[75] Inventor: Achim Jost, Heidelberg-Schlierbach, Germany

[73] Assignee: Heidelberger Druckmaschinen AG, Heidelberg, Germany

[21] Appl. No.: 726,813

[22] Filed: Oct. 7, 1996

[30] Foreign Application Priority Data

Oct. 6, 1995 [DE] Germany ..... 195 37 284.0

[51] Int. Cl.[6] ..... B65H 3/08

[52] U.S. Cl. ..... 271/90; 271/11

[58] Field of Search ..... 271/11, 90, 93, 271/98, 105

[56] References Cited

U.S. PATENT DOCUMENTS 2,156,139 4/1939 Backhouse ..... 271/98
3,482,833 12/1969 Schleiden .

FOREIGN PATENT DOCUMENTS 17 86 232 1/1972 Germany .
3817287 12/1988 Germany ..... 271/98
3912456 11/1989 Germany ..... 271/11
7503 3/1900 United Kingdom ..... 271/105

*Primary Examiner*—H. Grant Skaggs
*Attorney, Agent, or Firm*—Herbert L. Lerner; Laurence A. Greenberg

[57] ABSTRACT

A sheet supply device of a sheet-fed machine, in particular a printing press, includes a sheet guide element that is adjustable lengthwise and crosswise to a sheet format. Strips that guide the top leading region of a sheet rising on an air cushion extend above a sheet stack downward from a suction head at an incline relative to the surroundings toward a transfer point to the sheet-fed machine. The bands are rolled up onto winding rollers that are acted upon by a restoring force, so that the bands are kept wound or are always kept under tension. In another version, the bands are constructed as elastic bands. At sides of the transfer point, outer bands are mounted on a lateral stack stop and inner bands are mounted on mounts which are adjustable cross-wise of the sheets. When the suction head and the lateral stack stops are adjusted, the bands shorten or lengthen in accordance with the adjustment, so that for each format the sheet is guided over its full width.

16 Claims, 3 Drawing Sheets

SHEET GUIDE DEVICE FOR SHEET FEEDERS

BACKGROUND OF THE INVENTION

Field of the Invention

The invention relates to a sheet guide device for a supply region of a sheet-fed machine, in particular a printing press, which guides the sheets after separation from a feeder stack.

When sheets in a stack of sheets are supplied to sheet-fed machines, it is conventional to use a suction feed device which includes lifting suction devices and drag suction devices. The separation of the topmost sheet from a stack is carried out by aspirating the sheet in a lower position with the lifting suction devices and then raising the lifting suction devices. While the sheet is in the raised position, blown air is passed beneath the sheet by separating blowers operating from the rear edge of the stack, in order to reinforce the separation of the sheet from the stack and the raising of the sheet, while in order to maintain the air pressure, lateral loosening blowers blow air continuously against the side edges of the stack in the leading portion of the sheet. Once the lifting suction devices have reached their highest position, horizontally reciprocating feed suction devices (drag suction devices) take over the sheet from the lifting suction devices in that they aspirate the sheets, and the suction at the lifting suction devices is turned off. Next, the feed suction devices transport the sheets by a horizontal motion in the direction of the sheet-fed machine, so that the leading portion of the sheet arrives at a transfer point where there are sheet transport devices of the downstream sheet-fed machine, such as conveyor belts guided through a feeder table. The takeover by the sheet transport device of the sheet-fed machine is effected by synchronized lowering of synchronizing rollers, as a result of which the sheet is pressed against the revolving conveyor belts. Simultaneously with the lowering of the synchronizing rollers, the supply of suction to the feed suction devices is discontinued, and the feed suction devices are moved to their rear position in terms of the sheet feeding direction. Since the sheet moves along the transport path away from the rear loosening blowers, air increasingly reaches the upper side of the sheet, causing the sheet to flutter. This threatens the stable, reliable transporting of the raised sheet, especially in the leading region of the sheet, over a specified transport path to the sheet-fed machine and thus threatens the arrival of the sheet at the transfer point that is meant to be adapted to the pace of the sheet-fed machine.

In order to solve that problem, sheet guide elements are used above the sheet travel path. One such sheet guide element is known from German Published, Non-Prosecuted Patent Application DE 17 86 232 A1. In the supply region of a sheet supply device disclosed therein, the sheet is guided on its top side along the sheet travel path above the sheet stack by a plurality of horizontally disposed sheet guide rods that can be lengthened in telescoping fashion. The telescoping rods extend above the sheet stack from a crossbar, that is located downstream of the suction head in the sheet feeding direction, is disposed crosswise to the sheet feeding direction and is connected to the suction head, horizontally in a single plane as far as the transfer point to a feeder table of a printing press. Upon a format-dependent adjustment of the suction head in or counter to the sheet feeding direction, the aforementioned sheet guide rods are compressed in telescoping fashion. The tubular portions of the sheet guide rods form stepwise-extending segments. The guide elements are essentially dimensionally stable. A substantial disadvantage is that the sheet guide elements require maintenance for the sake of their functional reliability, since the telescoping rods are exposed to increasing wear from soiling and abrasion.

SUMMARY OF THE INVENTION

It is accordingly an object of the invention to provide a sheet guide device for sheet feeders, which overcomes the hereinafore-mentioned disadvantages of the heretofore-known devices of this general type, which guides sheets reliably and without damage in a supply region of sheet-fed machines, especially printing presses, and which can be adjusted to both lengthwise and crosswise sheet format.

With the foregoing and other objects in view there is provided, in accordance with the invention, a sheet guide device for a supply region of a sheet-fed machine, comprising a suction feed device to be adjusted by a given amount in and counter to a sheet feeding direction; sheet guide elements to be lengthened by the given amount, the sheet guide elements being disposed above a sheet feeding plane and having a stationarily secured side facing toward a sheet-fed machine as seen in the sheet feeding direction and an opposite side secured at the suction feed device, each of the sheet guide elements being a unit including a bandlike body and at least one winding roller acted upon by a reverse-winding force for winding up the bandlike body; a format adjusting region; and mounts disposed at the side facing toward the sheet-fed machine for securing the sheet guide elements, some of the mounts being disposed in the format adjusting region, for adjusting at least the mounts in the format adjusting region crosswise to the sheet feeding direction.

With the objects of the invention in view there is also provided a sheet guide device for sheet supply devices for a supply region of a sheet-fed machine, comprising a suction feed device to be adjusted by a given amount in and counter to a sheet feeding direction; sheet guide elements to be lengthened by the given amount, the sheet guide elements being disposed above a sheet feeding plane and having a stationarily secured side facing toward a sheet-fed machine as seen in the sheet feeding direction and an opposite side secured at the suction feed device, and the sheet guide elements being bandlike bodies of a highly elastic material; a format adjusting region; and mounts disposed at the side facing toward the sheet-fed machine for securing the sheet guide elements, some of the mounts being disposed in the format adjusting region, for adjusting at least the mounts in the format adjusting region crosswise to the sheet feeding direction.

One advantage of the invention is that the sheet guide elements can be adjusted to format not only lengthwise of the sheets but also crosswise of the sheets, so that the lateral format adjustment by such devices as lateral stack stops or lateral loosening blowers is not hindered by the sheet guide element and nevertheless sheet guidance is effected over the full width of the sheet. A further advantage of the invention is that stepless guide devices with little friction are created. Since the guide elements are under tensile strain, they exert a damping holding-down force on the sheet to be transported. This prevents damage to the top of the sheet, especially when already printed sheets are set down again. Moreover, the sheet guide elements of the invention offer the advantage of requiring extremely little maintenance. The embodiment of the guide elements as being formed of expandable material makes it possible to omit winding rollers, making for an extremely simple, spacing-saving construction with the same functional capability as essentially nonelastic bands with a winding roller. An advantage of this further feature of the invention is that the sheet guide elements or winding rollers are secured to the mounts on which the lateral stack stops and/or lateral loosening blowers are mounted. Due to this provision, the sheet guide elements are readily adapted to any format adjustment, so that operation of both the lateral stack stops and the sheet guide element is effected in a single operation. This is especially advantageous in the case of a fully automatic adjustment of the lateral stack stops and loosening blowers, etc., to the sheet format, since a separate adjusting device for the sheet guide element (guide elements) becomes unnecessary. Collisions between the carriers and the sheet guide element are precluded by mounting the inner sheet guide elements disposed between the format adjusting regions on the laterally adjustable carriers on which the synchronizing rollers for holding the sheet down onto the transport device at the transfer point to the sheet-fed machine are mounted. A further reduction in the number of components necessary for the sheet guide element of the invention is achieved through the use of single or multiple reciprocation of the bandlike bodies.

In accordance with another feature of the invention, the sheet guide element is inclined in the sheet feeding direction relative to the top of the stack. As a result, the sheets are guided precisely to the transfer point leading to a downstream transport roller.

In accordance with a further feature of the invention, the bandlike bodies have a sheathing or coating of a material with a low coefficient of friction.

In accordance with an added feature of the invention, some of the mounts are disposed between the format adjusting regions, and the mounts disposed between the format adjusting regions are mounted for adjustment crosswise to the sheet feeding direction.

In accordance with an additional feature of the invention, there are provided stack stops to be adjusted crosswise to the sheet feeding direction for mounting the sheet guide elements, instead of the mounts disposed in the format adjusting region.

In accordance with yet another feature of the invention, there are provided deflectors disposed on the suction feed device for deflecting the bandlike bodies of the sheet guide elements downward in vertical direction.

In accordance with yet a further feature of the invention, the deflectors are mounted adjustably in vertical direction relative to the suction feed device.

In accordance with yet an added feature of the invention, the deflectors have lower ends with rollers for guiding the bandlike bodies.

In accordance with yet an additional feature of the invention, there are provided deflectors between the mounts on sides of the sheet-fed machine and of the suction feed device, for guiding the bandlike bodies of at least one of the sheet guide elements back and forth at least once.

In accordance with again another feature of the invention, more than one of the bandlike bodies are wound in common onto one winding roller.

In accordance with a concomitant feature of the invention, the sheet guide elements are formed of rubber.

Other features which are considered as characteristic for the invention are set forth in the appended claims.

Although the invention is illustrated and described herein as embodied in a sheet guide device for sheet feeders, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
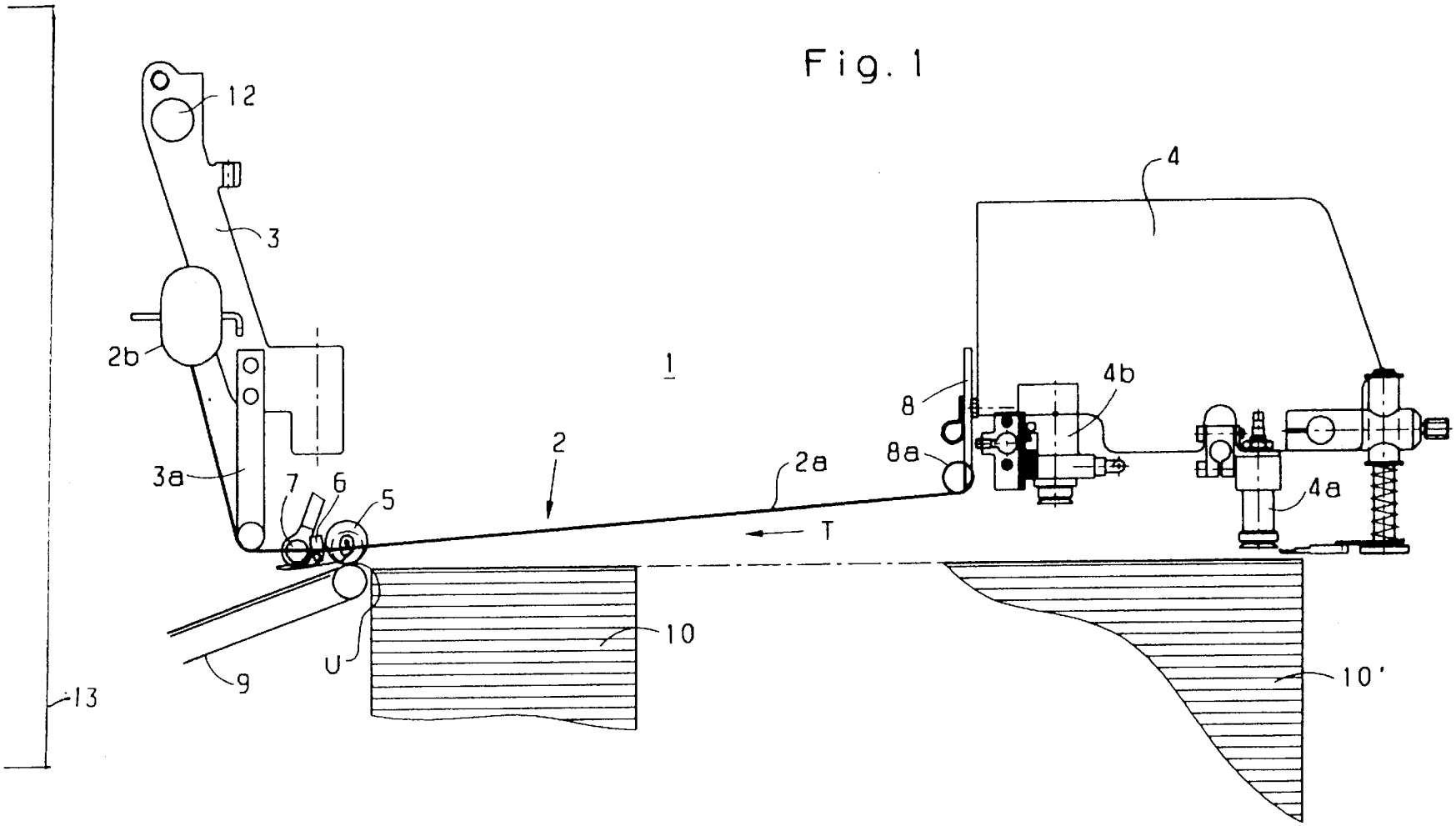
FIG. 1 is a diagrammatic, side-elevational view of a sheet guide device according to the invention.

Referring now to the figures of the drawings in detail and first, particularly, to FIG. 1 thereof, it is seen that a sheet is separated in a known manner from a sheet stack 10, 10' and transported in the direction of a sheet-fed machine 13 through the use of a suction feed device 4 having lifting suction devices 4*a* and drag suction devices 4*b*. During this transporting, an upper surface of the sheet is guided, in a region between a transfer point U and the drag suction devices 4*b*, through the use of a sheet guide device 1. The transfer point U in this case means the point in which contact of synchronizing rollers 5 with the sheet in the region of the leading edge of the sheet places the sheet into contact with sheet conveyor belts 9 and the transfer to the sheet-fed machine 13 is thus made. The sheet guide device 1 has a plurality of sheet guide elements 2, for instance four of them, disposed side by side. However, as needed, fewer or more sheet guide elements may be used. The sheet guide elements 2 are each formed of a combination of one bandlike body 2*a* and one winding roller 2*b* each, wherein one end of the bandlike body 2*a* is secured to the winding roller. The bandlike body 2*a* is a band, rope or cord made of steel, plastic, natural fibers or some similar material. The winding roller 2*b* is constructed to be self-winding, in that it is acted upon in one direction of rotation by a restoring force, for instance a spiral spring, in a known manner. The winding direction depends on the direction in which the restoring force is exerted on the winding roller. The sheet guide elements 2 are secured at a free end of the bandlike bodies 2*a* on a leading lower edge of the suction feed device 4, as seen in a sheet feeding direction T, and at their other end the winding rollers 2*b* are mounted on mounts or brackets 3, which are mounted on the side of the device pointing toward the sheet-fed machine 13. The winding rollers 2*b* are attached to the mounts or supports 3 directly above the sheet transport path. However, in order to gain accessibility to the sheet transport path the bandlike bodies 2*a*, between the winding roller 2*b* and the fastening at the free end to sides of the suction feed device 4, are deflected to a location immediately above the sheet transport path. As is shown in FIG. 1, the deflection is accomplished by additional deflection elements 3*a* mounted in fixed fashion to the mounts 3.

Figure 2:
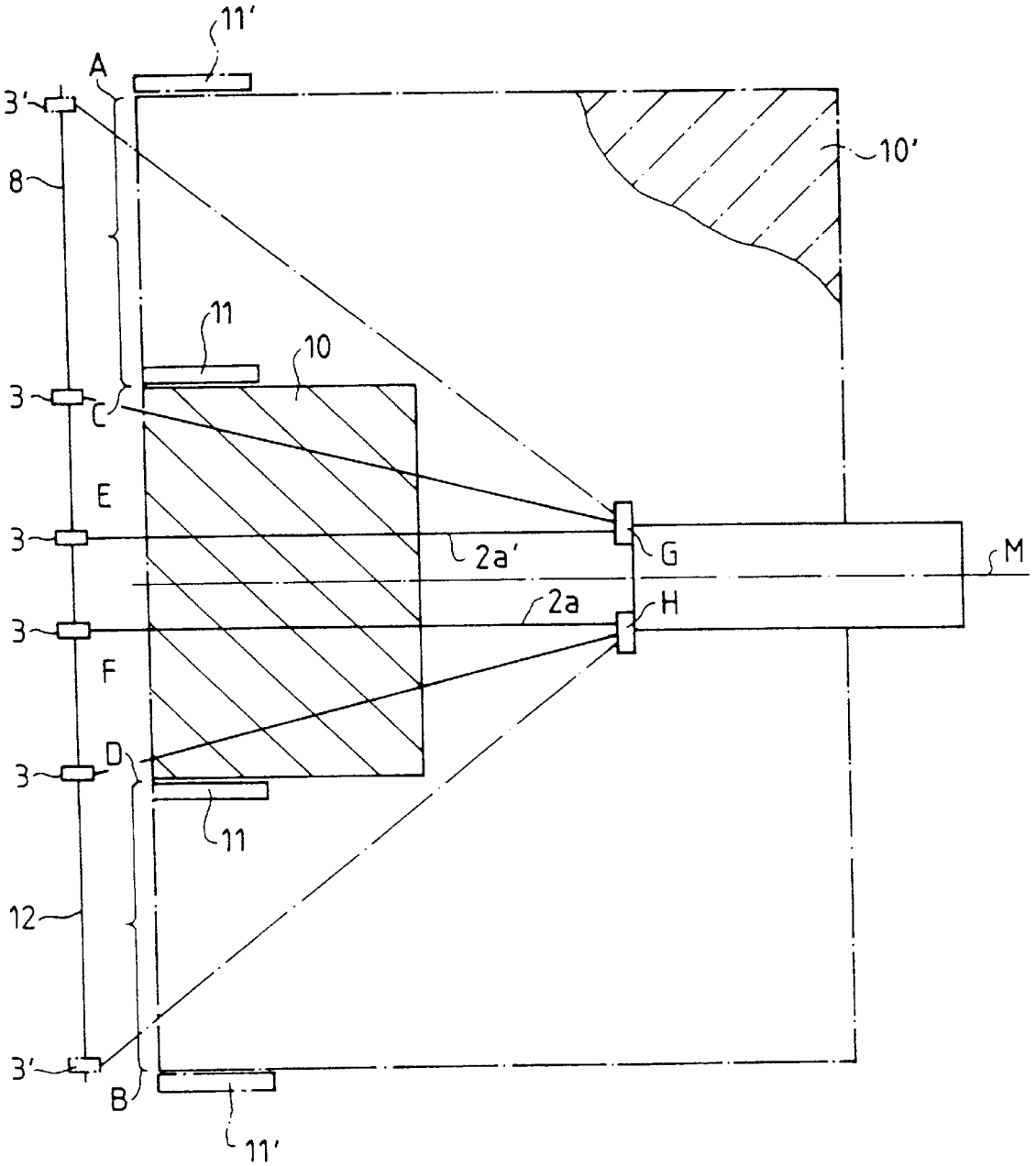
FIG. 2 is a plan view of the sheet guide device according to the invention.
Figure 3:
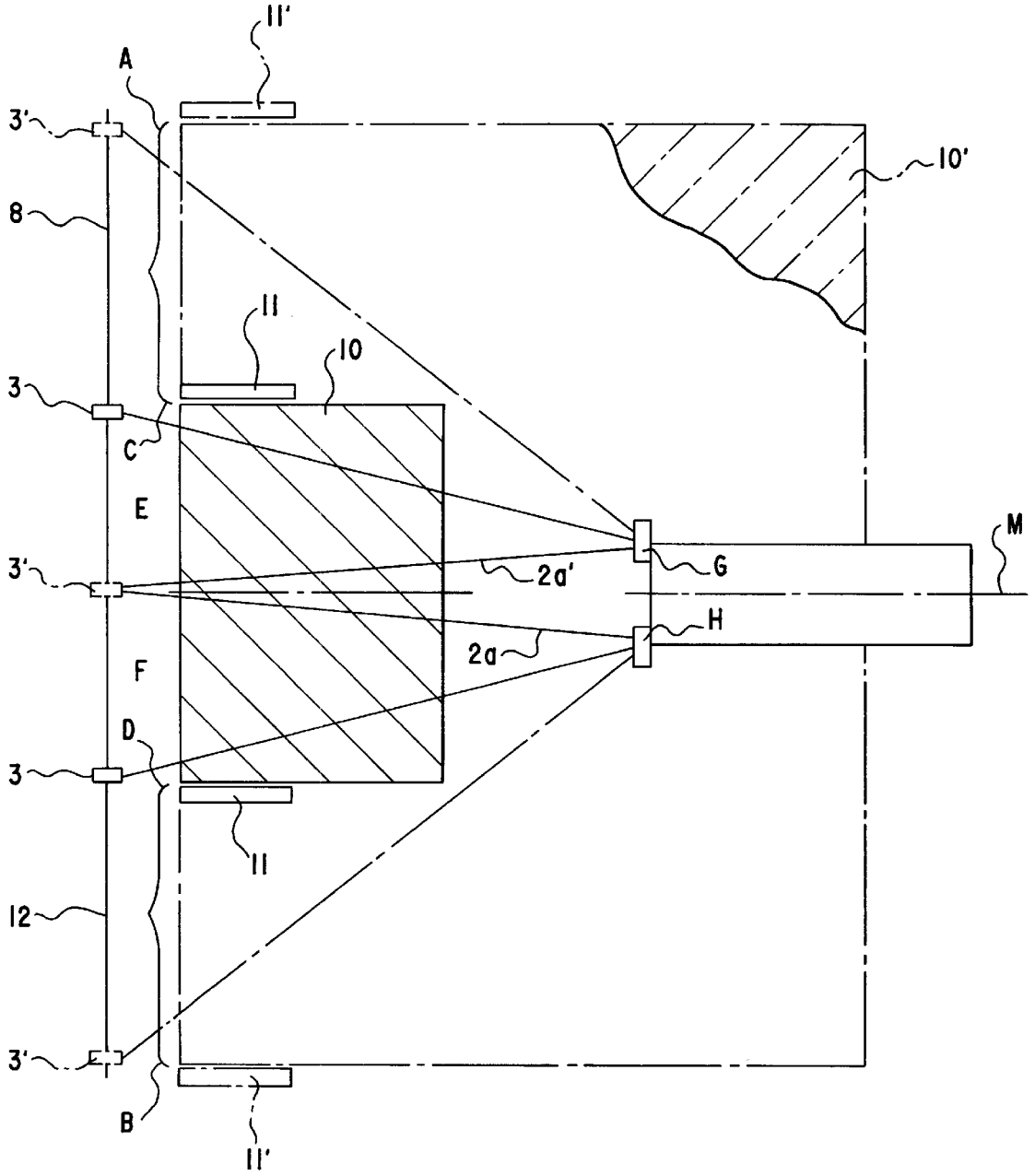
FIG. 3 is a plan view of the sheet guide device showing two bandlike bodies on a common winding roller.

With reference to FIG. 2, an adjustment to a crosswise sheet format is effected at the mounts 3, which are disposed in format adjustment regions. The term "format adjustment region" indicates portions AC and BD between points A and B, respectively, that are located in the vicinity of lateral edges of the sheets for a maximum crosswise sheet size, and points C and D, which are located in the vicinity of side edges of the sheet for a minimum crosswise sheet size. Lateral sheet stops 11 are positioned against the feeder stack 10 by movement crosswise to the sheet feeding direction T. The mounts 3 that are disposed in the format adjusting region (AC, BD) are placed crosswise to the sheet feeding direction so far toward a middle M of the machine that they extend over the region of the corners of the leading edge of the sheet to be supplied when this sheet is at the transfer point U. Through the use of this provision, guidance is achieved over the full width of the sheet precisely in the region of the leading edge of the sheet immediately before transfer to the sheet-fed machine 13, which is especially critical for reliable supply of the sheet to the sheet-fed machine 13. In this way the lateral stack stops 11 can also be brought into contact with the sides of the sheet stack 10, without colliding with the affected mounts 3 or the associated guide elements 2.

In order to mount the mounts 3, a crossbar 12 is provided at a right angle to the sheet feeding direction T between the side portions of the sheet supply device. The mounts 3, which are disposed in the format adjusting regions AC, BD, are mounted displaceably on the crossbar 12 between the points A and C on one hand and the points B and D on the other hand crosswise to the sheet feeding direction T, in accordance with the crosswise sheet format. The mounts 3, which are disposed in the middle between the format adjusting regions AC, BD, are not adjusted. In order to ensure that the sheet guide elements 2 will always be under tension, the length of the bandlike bodies 2*a* is chosen in each case in such a way that when the suction feed device 4 and the mounts 3 disposed in the format adjusting regions AC, BD have been adjusted to the minimum sheet format, they are wound from the winding roller 2*b* far enough to ensure that the restoring force of the winding rollers 2*b* is exerted on the bandlike bodies 2*a*. The result for the bandlike bodies 2*a* is a different length as applicable. The bandlike bodies 2*a* of the sheet guide elements 2 that are placed farthest from the machine middle M for maximum sheet size, are longer than those of the sheet guide elements 2 located nearer the machine middle.

In order to assure reliable guidance of the sheets through the use of the sheet guide elements 2 as far as the transfer point U, the sheet guide elements 2 are secured to the mounts 3 downstream of the sheet transfer point U. To that end, the sheet guide elements 2 are passed through, beyond the transfer point U, under a rotatable synchronizing roller shaft 7, to which the synchronizing rollers 5 are secured through the use of carriers 6. Since the distance of the front edge of the suction feed device 4 pointing to the sheet-fed machines, that is the edge at which the sheet guide elements 2 are secured, is greater than the distance from the synchronizing roller shaft 7 to the top of the sheet stack 10, the result is an inclination of the sheet guide elements 2 in the sheet feeding direction T, due to which the sheet guide device 1 and the top of the sheet stack 10 converge in funnel-like fashion as seen in a side view. As a result, the leading edge of the transported sheet or stream of sheets is carried reliably to the transfer point U.

In order to avoid damage to the particular sheet from the sheet guide elements 2, the bandlike bodies 2*a* are provided with a coating or sheathing, for instance of silicone or plastics, which has low friction with respect to the surface of the sheets to be transported and/or is ink-repellent.

According to a further feature of the invention, the mounts 3 disposed in the portion CD between the format adjusting regions AC, BD are mounted, like the other mounts 3, in such a way as to be adjustable crosswise to the sheet feeding direction T on the crossbar 12, in order to vary the spacings between the sheet guide elements 2 as a function of the stiffness of the sheet to be supplied. In this way it is moreover attained that the adjusting region, in which the carriers 6 with the synchronizing rollers 5 can be displaced crosswise to the sheet feeding direction T, is not limited by the mounts 3. The adjustment can be manually or automatically carried out, through the use of a separate drive device for the mounts disposed between the format adjusting regions AC, BD.

In order to make it possible to dispense with a separate adjustment of the mounts 3 disposed in the format adjusting regions AC, BD and the lateral sheet stops 11, and at the same time to enable collisions between the mounts 3 and the lateral sheet stops 11 to be precluded, according to a further feature of the invention the lateral stack stops 11 or the provisions on which the lateral stack stops 11 are mounted and with which the lateral stack stops 11, 11' are adjusted crosswise to the sheet feeding direction in the format adjusting region AC, BD, are used as the mounts 3. In this way, the guide elements 2 follow the lateral stack stops 11 and always cover the full width of the sheet in a single operation.

According to a further feature of the invention, extensions or deflectors 8 mounted vertically on the front edge of the suction feed device 4 deflect the sheet guide elements to a certain distance away from the level of the top of the stack. These extensions are constructed preferably to be adjustable in the vertical direction, to allow a variation in the inclination of the sheet guide elements of the mount 3 to the suction feed device 4 as a function of the behavior of the sheets to be supplied. In order to reduce friction between these extensions 8 and the sheet guide elements 2, the extensions 8 have rollers 8*a* on their lower end. According to a further feature of the invention, deflection elements, in the form of hooks that are open at the top or closed eyelets, are provided on the mounts 3 and/or the suction feed device 4. Through the use of these deflection elements, a bandlike body 2*a* is returned from the winding roller through the suction feed device 4 to a further mount 3 on the side toward the sheet-fed machine 13, for example from a point E through a point G on the front edge of the suction feed device 4 to the point A, and from a point F through a point H to the point B. In the same way, a sheet guide element 2 can be guided back and forth alternatingly in zig-zag fashion, multiple times between the suction feed device 4 and the mounts 3. According to a further non-illustrated embodiment, the sheet guide elements can be suspended by one or both ends from the suction feed device or from the mounts 3, by providing that hook elements are formed on the mounts and loops, or hooks or knots are constructed on the sheet guide elements.

In order to reduce the diameter of the winding rollers 2*b* and thus the requisite installation space, or to achieve a longer windup length, it is also possible to provide two winding rollers 2*b* for each of the bandlike bodies 2*a*, on each of which one end of the bandlike body 2*a* is then secured. It is also possible to secure more than one bandlike body 2*a* on one common winding roller 2*b*, as long as all of the affected bandlike bodies 2*a* have the same length or are disposed in such a way that they are lengthened or shortened in the same proportion upon a format adjustment.

An alternative version includes replacing the bandlike bodies 2*a* and winding rollers 2*b* described above with highly elastic sheet guide elements 2. The term "highly elastic sheet guide elements" in this case means sheet guide elements 2 that are constructed as rubber bands, springs or the like. When such highly elastic guide elements are used, the use of winding rollers 2*b* becomes unnecessary. No other structural changes from the above-described exemplary embodiment are required for the function of the invention.

The sheet guide device 1 is adjusted in accordance with the format of the sheets to be supplied in such a way that the sheet guide elements 2 disposed in the format adjusting regions extend across the region of corners of the leading edge of the sheet when that edge is at the transfer point U, so that the sheets in the region of the leading edge are guided over their full width upstream of the transfer point U to the sheet-fed machine 13. The sheet guide elements 2 disposed in the portion CD, between the format adjusting regions AC, BD, are adjusted in accordance with the way in which the sheets behave. If they are mounted on the carriers 6 of the synchronizing rollers 5, they follow the adjustment of those elements. A sheet that is resting on a support, or a sheet that is fluttering because of the separating air supplied from the rear edge of the sheet stack, is held down with a damping force by the sheet guide elements 2, in such a way that the bandlike bodies 2*a* are under tensile strain. The inclination of the sheet guide elements 2 minimizes the length along which the sheet rests on the sheet guide elements, since the sheet does not come into contact with the sheet guide elements 2 until the middle region of the sheet guide elements 2.

A sheet that is rising or bulging upward in the course of transport does not come into contact with the sheet guide elements 2 directly downstream of the suction feed device 4, but rather at a certain distance from the suction feed device 4, because of the inclination of the sheet guide elements 2. Since the sheet is pushed in its rear end region, the top of the sheet slides along the sheet guide elements 2 and is deflected by the inclination of the sheet guide elements into the immediate vicinity of the transfer point U to the sheet-fed machine 13. While the first sheet comes into direct contact with the sheet guide elements 2 over its full length, the following sheets, because of the shingled or overlapping supply, only touch the sheet guide elements 2 in the trailing portion of the sheet surface. Since a plurality of sheets rest one on the other as a result of the shingled position, the rigidity of the sheet stream increases, so that the sheet motion in the vertical direction (fluttering) is stabilized, and through the use of the invention guidance over the full sheet width in the trailing portion of the sheets as well is not necessary. As a result, the contact between the sheets and the sheet guide elements is further reduced, and the danger of damage to the top of the sheet, especially when already-printed sheets rest on it, is reduced.

The sheet guide elements 2 constructed according to the invention compensate for the adjustment of the suction feed device 4 (in the sheet feeding direction T) and of the mounts 3, or if the sheet guide elements 2 to be adjusted are brought to the lateral stack stops 11 (orthogonally to the sheet feeding direction T) in the format adjusting regions AC and BD. If the suction feed device 4 is adjusted in the sheet feeding direction to the sheet size, then the sheet guide elements 2 shorten corresponding to the adjustment, in such a way that the winding rollers 2*b* wind up the bandlike bodies 2*a* because of the restoring force. If the suction feed device 4 is adjusted counter to the sheet feeding direction T to a larger sheet size, then the sheet guide elements 2 lengthen, since the bandlike bodies 2*a* are unwound from the aforementioned winding rollers 2*b* counter to the restoring force. Depending on the distance of the mounts 3 from the longitudinal center or middle M of the machine, this lengthening or shortening of the sheet guide elements 2 relative to the course of adjustment of the suction feed device 4 varies. If the sheet stops 11, 11' are adjusted crosswise to the sheet feeding direction T, then the aforementioned mounts 3 are adjusted to the same extent between the points A and C or the points B and D. The adjustment path is compensated for by the winding rollers 2*b,* as described above. If a smaller sheet size is put in place, then the suction feed device 4, as a function of the longitudinal sheet size, moves forward in the sheet feeding direction T and the lateral sheet stops 11, 11' move together. As a result, all of the sheet guide elements 2 shorten, while maintaining their tension. Upon an adjustment to a larger sheet size, the sheet guide elements 2 are shortened by the reverse motion of the suction feed device 4 and of the lateral stack stops 11, 11'. With the adjustment of the synchronizing rollers 5 or the carriers 6 that carry them crosswise to the sheet feeding direction T on the crossbar 12, for instance in print-free regions of sheets that are already printed on the top side, the sheet guide elements 2 readily follow the adjustment. The sheet guide device 1 can be brought out of a working position, for instance when sheets of high stiffness are supplied, by removing the bandlike bodies 2 from suspension in the described transfer devices or hooklike fastenings on the mounts 3 or suction feed device 4.

Depending on the behavior of the sheets to be supplied, the inclination of the sheet guide elements 2 in the vertical direction has varied by the adjustment of the mounts 8 to sides of the suction feed device 4.

I claim:

1. A sheet guide device for a supply region of a sheet-fed machine, comprising:

a suction feed device to be adjusted by a given amount in and counter to a sheet feeding direction;

sheet guide elements to be lengthened by said given amount, said sheet guide elements being disposed above a sheet feeding plane and having a stationarily secured side facing toward a sheet-fed machine as seen in said sheet feeding direction and an opposite side secured at paid suction feed device, each of said sheet guide elements being a unit including a bandlike body and at least one winding roller acted upon by a reverse-winding force for winding up said bandlike body;

deflectors having lower ends with rollers disposed on said suction feed device for deflecting and guiding said bandlike bodies of said sheet guide elements downward in a vertical direction;

a format adjusting region; and mounts disposed at said side facing toward the sheet-fed machine for securing said sheet guide elements, some of said mounts being disposed in said format adjusting region, for adjusting at least said mounts in said format adjusting region crosswise to said sheet feeding direction.

2. The sheet guide device according to claim 1, wherein said sheet guide elements are disposed in a plane being spaced from a surface of a sheet stack by a distance decreasing continuously as seen from said suction feed device along said sheet feeding direction.

3. The sheet guide device according to claim 1, wherein said bandlike bodies have a sheathing or coating of a material with a low coefficient of friction.

4. The sheet guide device according to claim 1, wherein some of said mounts are disposed between said format adjusting regions, and said mounts disposed between said format adjusting regions are mounted for adjustment crosswise to said sheet feeding direction.

5. The sheet guide device according to claim 1, including stack stops to be adjusted crosswise to said sheet feeding direction for mounting said sheet guide elements.

6. The sheet guide device according to claim 1, wherein said deflectors are mounted adjustably in vertical direction relative to said suction feed device.

7. The sheet guide device according to claim 1, including further deflectors between said mounts disposed at said side facing toward the sheet-fed machine and of said suction feed device, for guiding said bandlike bodies of at least one of said sheet guide elements.

8. The sheet guide device according to claim 1, wherein more than one of said bandlike bodies are wound in common onto one winding roller.

9. A sheet guide device for sheet supply devices for a supply region of a sheet-fed machine, comprising:

a suction feed device to be adjusted by a given amount in and counter to a sheet feeding direction;

sheet guide elements to be lengthened by said given amount, said sheet guide elements being disposed above a sheet feeding plane and having a stationarily secured side facing toward a sheet-fed machine as seen in said sheet feeding direction and an opposite side secured at said suction feed device, and said sheet guide elements being bandlike bodies of a highly elastic material;

deflectors having lower ends with rollers disposed on said suction feed device for deflecting and guiding said bandlike bodies of said sheet guide elements downward in a vertical direction;

a format adjusting region; and mounts disposed at said side facing toward the sheet-fed machine for securing said sheet guide elements, some of said mounts being disposed in said format adjusting region, for adjusting at least said mounts in said format adjusting region crosswise to said sheet feeding direction.

10. The sheet guide device according to claim 9, wherein said sheet guide elements are disposed in a plane being spaced from a surface of a sheet stack by a distance decreasing continuously as seen from said suction feed device along said sheet feeding direction.

11. The sheet guide device according to claim 9, wherein said bandlike bodies have a sheathing or coating of a material with a low coefficient of friction.

12. The sheet guide device according to claim 9, wherein some of said mounts are disposed between said format adjusting regions, and said mounts disposed between said format adjusting regions are mounted for adjustment crosswise to said sheet feeding direction.

13.The sheet guide device according to claim 9, including stack stops to be adjusted crosswise to said sheet feeding direction for mounting said sheet guide elements.

14. The sheet guide device according to claim 9, wherein said deflectors are mounted adjustably in vertical direction relative to said suction feed device.

15. The sheet guide device according to claim 9, including further deflectors between said mounts disposed at said side facing toward the sheet-fed machine and of said suction feed device, for guiding said bandlike bodies of at least one of said sheet guide elements.

16. The sheet guide device according to claim 9, wherein said sheet guide elements are formed of rubber.

* * * * *